US006240741B1

(12) United States Patent
Dozhier

(10) Patent No.: US 6,240,741 B1
(45) Date of Patent: Jun. 5, 2001

(54) BEVERAGE BOTTLE HOLDER SYSTEM

(76) Inventor: Brian D. Dozhier, 140 Stubern Pine Rd., Jemez, NM (US) 87025

( * ) Notice: Subject to any disclaimer, the term of this patent is extended or adjusted under 35 U.S.C. 154(b) by 0 days.

(21) Appl. No.: 09/352,832

(22) Filed: Jul. 13, 1999

(51) Int. Cl.[7] ..... F25D 3/08

(52) U.S. Cl. ..... 62/457.3; 62/457.4; 62/371; 220/703; 220/739

(58) Field of Search ..... 62/457.3, 457.4, 62/371; 220/739, 740, 703

(56) References Cited

U.S. PATENT DOCUMENTS

| | | | | |
|---|---|---|---|---|
| D. 387,621 | * | 12/1997 | Sullivan et al. . | |
| 4,638,645 | * | 1/1987 | Simila | 62/457 |
| 4,798,063 | | 1/1989 | Rimmer | 62/457 |
| 4,932,225 | * | 6/1990 | Bighouse | 62/457.4 |
| 5,207,076 | | 5/1993 | Sciarrillo | 62/457 |
| 5,212,963 | | 5/1993 | McGinnis | 62/457 |
| 5,242,079 | * | 9/1993 | Stephens et al. | 220/709 X |
| 5,325,988 | | 7/1994 | Ekern | 220/411 |
| 5,406,808 | | 4/1995 | Babb et al. | 62/457 |
| 5,555,746 | | 9/1996 | Thompson | 62/457 |
| 5,975,336 | * | 11/1999 | Hart | 220/739 X |

* cited by examiner

*Primary Examiner*—Michael Buiz
*Assistant Examiner*—Chen-Wen Jiang
(74) *Attorney, Agent, or Firm*—Joseph N. Brea

(57) ABSTRACT

A beverage bottle holder system that includes insulated structures for surrounding a beverage bottle and insulating the beverage bottle to reduce the rate of warming of the beverage bottle. The top insulated structure includes an easily operated flip top dispensing spout for sealing a beverage bottle. A number of freezable ice rod elements are provided which are insertable into one of the insulated structures.

1 Claim, 3 Drawing Sheets

BEVERAGE BOTTLE HOLDER SYSTEM

TECHNICAL FIELD

The present invention relates to insulated beverage container holders and more particularly to a beverage bottle holder system hat includes an insulated top holding structure, an insulated lower holding structure and a number of freezable ice rod elements; the top holding structure having a flip top dispensing spout in connection with an internally threaded bottle neck receiving passageway that is in connection with a bottle top receiving cavity that is internally threaded to engage an exteriorly threaded upper portion of the insulated lower holding structure; the flip top dispensing spout being positioned in a first down position sealing the top holding structure and a second outwardly pivoted position allowing flow through the top holding structure; the insulated lower holding structure including an insulated foam structure shaped to define a bottle bottom cavity in the center thereof with a circumferential wall that has a number of ice rod receiving passageways formed therein sized to receive the freezable ice rod elements that are insertable into the ice rod receiving passageways to provide cooling elements, a handle extending from an exterior of the insulated lower holding structure, and a non-slip element in connection with the bottom portion of the insulated lower holding structure.

BACKGROUND ART

It is often desirable to maintain a beverage bottle, such as a one, two or three liter plastic beverage bottle, as cold as possible. It would be a benefit, therefore, to have a beverage bottle holder system that included insulated structures for surrounding the beverage bottle and insulating the beverage bottle to reduce the rate of warming of the beverage bottle. Because small children may have difficultly removing the cap from a beverage bottle and then holding and pouring the beverage from the beverage bottle into a glass or the like, it would be a further benefit if the beverage bottle holder system included a flip top dispensing spout for sealing the beverage bottle and a handle for providing a gripping structure more easily grasped by small hands.

GENERAL SUMMARY DISCUSSION OF INVENTION

It is thus an object of the invention to provide a beverage bottle holder system that includes an insulated top holding structure, an insulated lower holding structure and a number of freezable ice rod elements; the top holding structure having a flip top dispensing spout in connection with an internally threaded bottle neck receiving passageway that is in connection with a bottle top receiving cavity that is internally threaded to engage an exteriorly threaded upper portion of the insulated lower holding structure; the flip top dispensing spout being positioned in a first down position sealing the top holding structure and a second outwardly pivoted position allowing flow through the top holding structure; the insulated lower holding structure including an insulated foam structure shaped to define a bottle bottom cavity in the center thereof with a circumferential wall that has a number of ice rod receiving passageways formed therein sized to receive the freezable ice rod elements that are insertable into the ice rod receiving passageways to provide cooling elements, a handle extending from an exterior of the insulated lower holding structure, and a non-slip element in connection with the bottom portion of the insulated lower holding structure.

Accordingly, a beverage bottle holder system is provided. The beverage bottle holder system includes an insulated top holding structure, an insulated lower holding structure and a number of freezable ice rod elements; the top holding structure having a flip top dispensing spout in connection with an internally threaded bottle neck receiving passageway that is in connection with a bottle top receiving cavity that is internally threaded to engage an exteriorly threaded upper portion of the insulated lower holding structure; the flip top dispensing spout being positioned in a first down position sealing the top holding structure and a second outwardly pivoted position allowing flow through the top holding structure; the insulated lower holding structure including an insulated foam structure shaped to define a bottle bottom cavity in the center thereof with a circumferential wall that has a number of ice rod receiving passageways formed therein sized to receive the freezable ice rod elements that are insertable into the ice rod receiving passageways to provide cooling elements, a handle extending from an exterior of the insulated lower holding structure, and a non-slip element in connection with the bottom portion of the insulated lower holding structure.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
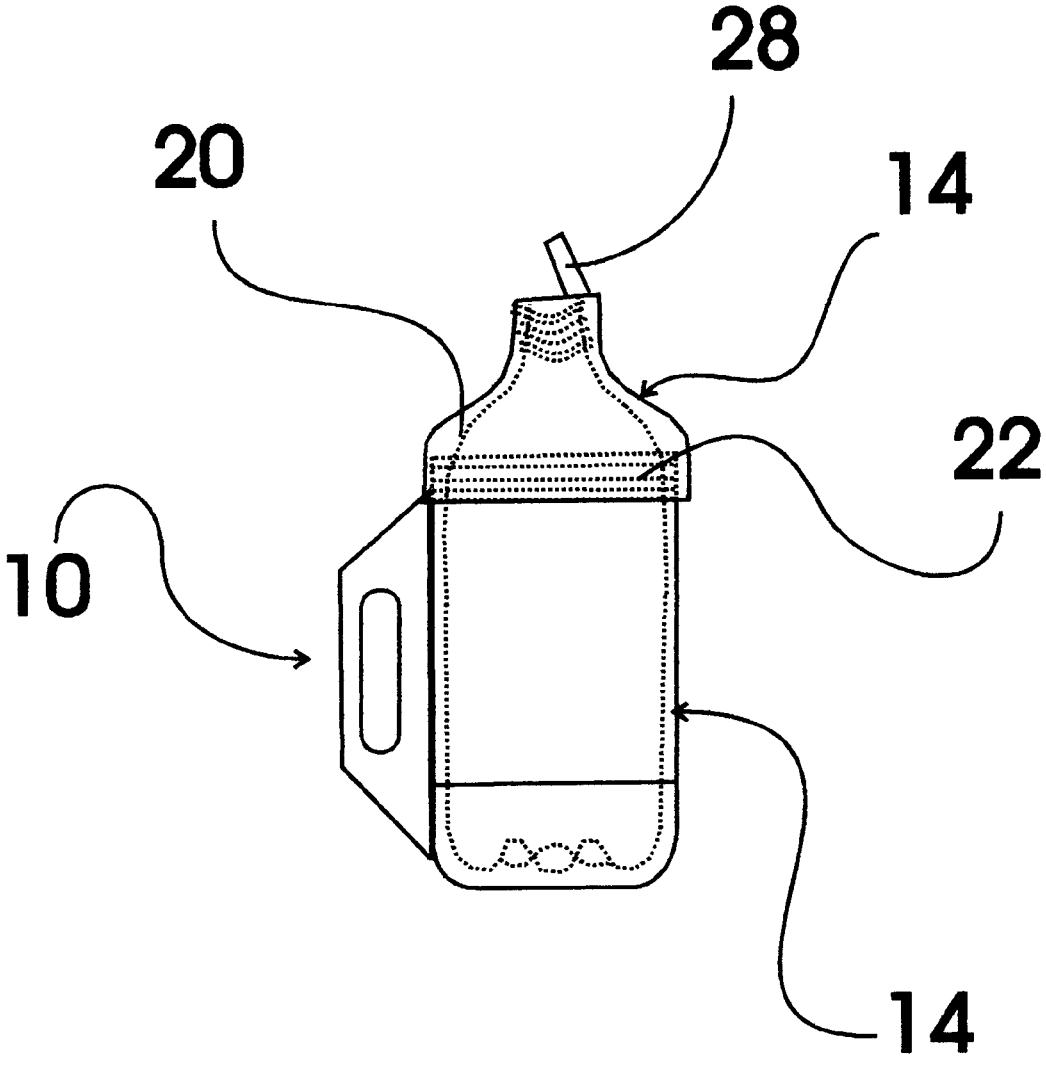
FIG. 1 is a side plan view of the beverage bottle holder system of the present invention showing the insulated top holding structure threaded onto the exteriorly threaded upper portion of the insulated lower holding structure; the top holding structure that is internally threaded to engage the exteriorly threaded upper portion of the insulated lower holding structure.
Figure 5:
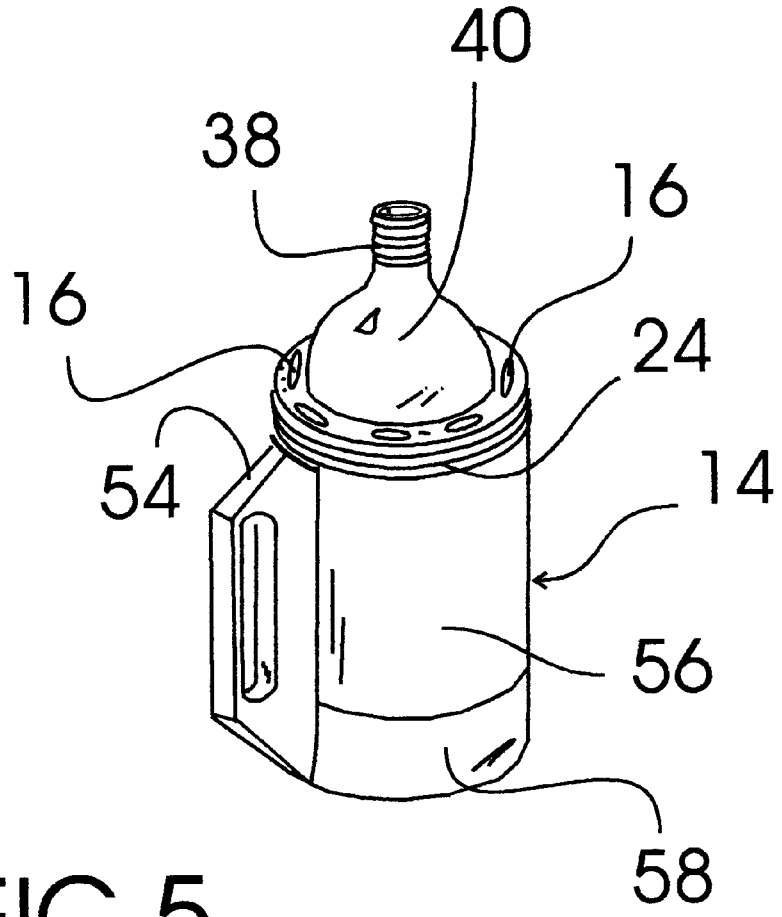
FIG. 5 is a perspective view showing the insulated lower holding structure with a representative beverage bottle inserted into the bottle bottom cavity and the eight ice rods inserted into the eight ice rod receiving passageways.
Figure 4:
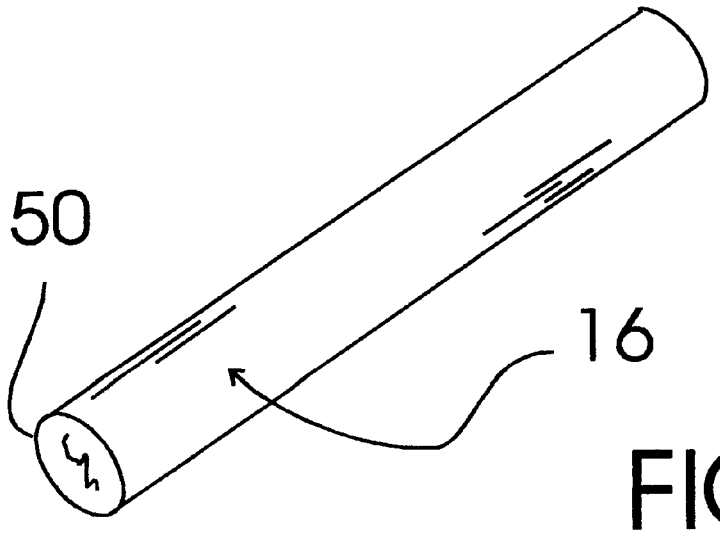
FIG. 4 is a perspective view showing one of the eight identical ice rods in isolation showing the rod shaped plastic containment structure filled with a freezable liquid.

FIG. 1 shows an exemplary embodiment of the beverage bottle holder system of the present invention, generally designated 10. Beverage holder system 10 is sized for use with two liter plastic beverage bottles, however, as stated early herein above, the beverage holder system of the invention is usable with beverage bottles of other shapes and sizes. Beverage bottle holder system 10 includes an insulated top holding structure, generally designated 12; an insulated lower holding structure, generally designated 14;

and eight identical freezable ice rod elements 16 (shown in FIGS. 4 and 5).

Figure 2:
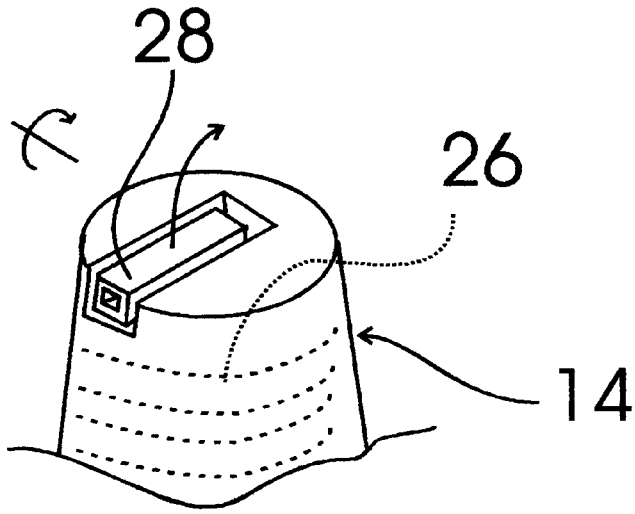
FIG. 2 is a perspective detail view of the top holding structure showing a bottle neck of a representative beverage bottle (in dashed lines) threaded into internally threaded bottle neck receiving passageway and the flip top dispensing spout in the second downward pivoted position.

Top holding structure 12 is constructed of molded foam and a bottle top receiving cavity 20 that is internally threaded 22 at the bottom to engage an exterior threaded upper portion 24 (FIG. 5) of insulated lower holding structure 14 and, referring to FIG. 2, a threaded bottle neck receiving cavity defined into the top portion thereof for screwing the top end 38 (FIG. 5) of a bottle into that is in connection with a flip top dispensing spout 28. Flip top dispensing spout is pivotal between a second downward pivot position sealing top holding structure 14 and a first upwardly pivoted dispensing position (shown in FIG. 1).

Figure 3:
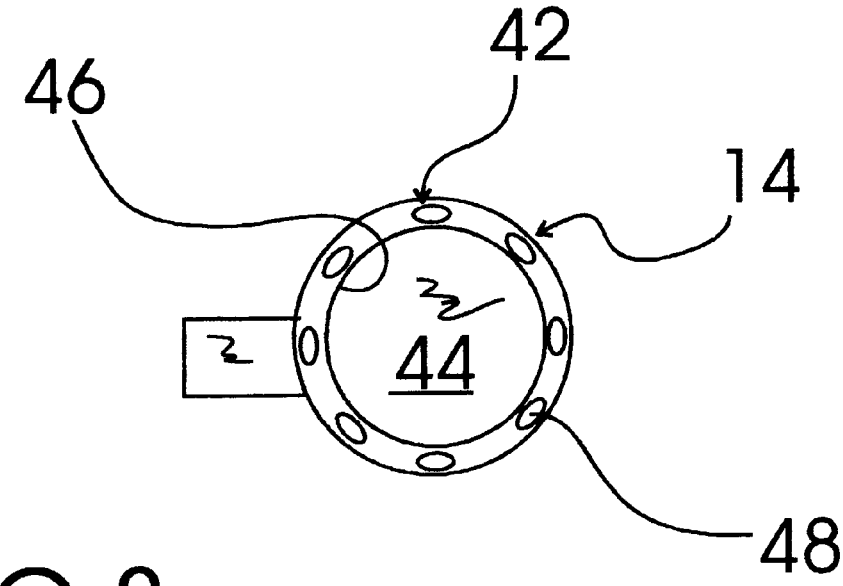
FIG. 3 is a top plan view of the insulated lower holding structure in isolation showing the circumferential wall of the insulated foam structure defining the bottle bottom cavity and the eight ice rod receiving passageways formed within the circumferential wall.

With reference to FIG. 3, insulated lower holding structure 14 includes an insulated foam structure, generally designated 42, shaped to define a cylinder shaped bottle bottom cavity 44 in the center thereof surrounded by a circumferential wall 46 that has eight ice rod receiving passageways 48 formed therein sized and shaped to receive, referring now to FIG. 4, the eight identical freezable ice rod elements 16. Each of the eight identical freezable ice rod elements 16 includes a rod shaped plastic containment structure 50 filled with a freezable liquid brine solution. Referring now to FIG. 5, a handle 54 extends from an exterior 56 of insulated lower holding structure 14, and a resilient plastic non-slip element 58 covers the bottom portion of insulated lower holding structure 58.

It can be seen from the preceding description that a beverage bottle holder system has been provided that includes an insulated top holding structure, an insulated lower holding structure and a number of freezable ice rod elements; the top holding structure having a flip top dispensing spout in connection with an internally threaded bottle neck receiving passageway that is in connection with a bottle top receiving cavity that is internally threaded to engage an exteriorly threaded upper portion of the insulated lower holding structure; the flip top dispensing spout being positioned in a first down position sealing the top holding structure and a second outwardly pivoted position allowing flow through the top holding structure; the insulated lower holding structure including an insulated foam structure shaped to define a bottle bottom cavity in the center thereof with a circumferential wall that has a number of ice rod receiving passageways formed therein sized to receive the freezable ice rod elements that are insertable into the ice rod receiving passageways to provide cooling elements, a handle extending from an exterior of the insulated lower holding structure, and a non-slip element in connection with the bottom portion of the insulated lower holding structure.

It is noted that the embodiment of the beverage bottle holder system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A beverage bottle holder system for beverage bottles having a threaded bottle neck with a bottle neck opening defined therethrough, said beverage bottle holding system comprising:

an insulated top holding structure;

an insulated lower holding structure; and a number of freezable ice rod elements;

said top holding structure having a flip top dispensing spout in connection with an internally threaded bottle neck receiving passageway that is in connection with a bottle top receiving cavity that is internally threaded to engage an exteriorly threaded upper portion of said insulated lower holding structure, said flip top dispensing spout being pivotally positionable into a first down position sealing said top holding structure and a pivotally positionable into a second outwardly pivoted position allowing flow through said flip top dispensing spout;

said insulated lower holding structure including an insulated foam structure shaped to define a bottle bottom cavity in said center thereof with a circumferential wall that has a number of ice rod receiving passageways formed therein sized to receive said freezable ice rod elements that are insertable into said ice rod receiving passageways to provide cooling elements, a handle extending from an exterior of said insulated lower holding structure, and a non-slip element in connection with said bottom portion of said insulated lower holding structure.

* * * * *